US010697272B2

(12) United States Patent
Falk et al.

(10) Patent No.: US 10,697,272 B2
(45) Date of Patent: Jun. 30, 2020

(54) WELL CLEANOUT SYSTEM

(71) Applicant: SOURCE ROCK ENERGY PARTNERS INC., Calgary (CA)

(72) Inventors: Kelvin Falk, Calgary (CA); Brandon Yorgason, Rockyford (CA)

(73) Assignee: Source Rock Energy Partners Inc., Calgary, AB (CA)

( * ) Notice: Subject to any disclaimer, the term of this patent is extended or adjusted under 35 U.S.C. 154(b) by 120 days.

(21) Appl. No.: 15/754,069

(22) PCT Filed: Aug. 26, 2016

(86) PCT No.: PCT/CA2016/051012
§ 371 (c)(1),
(2) Date: Feb. 21, 2018

(87) PCT Pub. No.: WO2017/031597
PCT Pub. Date: Mar. 2, 2017

(65) Prior Publication Data

US 2018/0238143 A1 Aug. 23, 2018

Related U.S. Application Data

(60) Provisional application No. 62/209,964, filed on Aug. 26, 2015.

(51) Int. Cl.
*E21B 37/00* (2006.01)
*E21B 33/127* (2006.01)

(52) U.S. Cl.
CPC ..... *E21B 37/00* (2013.01); *E21B 33/127* (2013.01)

(58) Field of Classification Search
CPC ..... E21B 37/00; E21B 37/02; E21B 37/04; E21B 37/045; E21B 37/10; E21B 33/127
See application file for complete search history.

(56) References Cited

U.S. PATENT DOCUMENTS

| | | | | |
|---|---|---|---|---|
| 5,033,545 | A * | 7/1991 | Sudol | B08B 9/035 134/167 C |
| 5,318,128 | A * | 6/1994 | Johnson | E21B 33/124 166/312 |
| 7,152,683 | B2 | 12/2006 | Khomynets | |
| 8,863,827 | B2 * | 10/2014 | Falk | E21B 37/00 166/105 |
| 2003/0150622 | A1 * | 8/2003 | Patel | E21B 34/105 166/373 |
| 2014/0053874 | A1 | 2/2014 | Mackenzie et al. | |

FOREIGN PATENT DOCUMENTS

| | | |
|---|---|---|
| CA | 1286601 C | 7/1991 |
| CA | 1325969 C | 1/1994 |
| GB | 2425136 A | 10/2006 |

OTHER PUBLICATIONS

International Search Report and Written Opinion for Int. Appl. No. PCT/CA2016/051012, dated Sep. 26, 2016, 10 pp.

* cited by examiner

*Primary Examiner* — David Carroll
(74) *Attorney, Agent, or Firm* — James A. Sheridan; Sheridan Law, LLC

(57) ABSTRACT

Apparatus and methodologies for cleaning a subterranean wellbore are provided. More specifically, a cleaning assembly and method of use is provided, the assembly being sealingly positioned within the wellbore and comprising a pump and a fluid control port for directing pressurized fluids downhole to clean the wellbore.

16 Claims, 5 Drawing Sheets

WELL CLEANOUT SYSTEM

CROSS-REFERENCE TO RELATED APPLICATIONS

This Application claims the benefit of claim of U.S. provisional application 62/209,964, filed Aug. 26, 2015, the entirety of which is incorporated herein by reference.

FIELD

Embodiments herein relate to apparatus and methodologies for evacuating accumulations of sand and other wellbore debris from a subterranean wellbore. More specifically, systems are provided for cleaning out a wellbore, and in particular for cleaning horizontal or deviated sections of the wellbore.

BACKGROUND

Various downhole well configurations, including vertical, directional, or horizontal, are used in oil and gas production from subterranean formations. With reference to FIG. 1, horizontal wells W typically comprise a relatively vertical section V (which may be vertical or off-vertical) and a relatively lateral section L (which may or may not be horizontal) that are connected by a curved 'build' section, often referred to as the 'heel' H. In almost all cases, the lateral section L is the productive target of the well W and will be configured to allow the inflow of fluids (oil/water/gas) from the reservoir into the wellbore.

Unfortunately, due to the configuration of horizontal wells, debris D can accumulate along the horizontal or deviated section of the well, clogging the annulus and impacting bottomhole pressure. Such debris, which can include residual drilling mud and/or cuttings, frac sand from post-frac stimulation treatments, produced formations sand, etc., can also damage downhole equipment. Over time, the built-up debris can significantly obstruct the wellbore, reducing production and requiring that the wellbore debris be removed or "cleaned" therefrom.

Various wellbore cleanout systems and methods have been developed for removing sand and other wellbore debris from horizontal wells. Mechanical tools for miling and scraping, hydraulic tools for getting and flow back, and chemical systems used to dissolve the debris or increasing fluid carrying capacities are known. To date, however, such systems have difficulty accessing debris forming beds underneath or uphole of the equipment, particularly with the development of longer horizontal sections (e.g. deeper wells). Such systems also have difficulty generating and maintaining sufficient fluid velocities to lift and carry the sand and debris along the wellbore and up to the surface, necessitating the use of large, complicated equipment, or the isolation of smaller section of bore to be cleaned.

Further, many systems often underperform due to lost circulation or poor circulation velocities, potentially causing fluid losses into the reservoir and significantly increasing operation costs. Systems can also be limited to the constraints of the reservoir, particularly where transport velocities and pick-up of the debris is restricted to the rate at which the reservoir can supply fluid to the wellbore. The resulting inflow rate is often insufficient to flush the sand, impairing the overall cleaning performance.

There is a need for a wellbore cleanout system that overcomes the above-noted problems.

SUMMARY

Apparatus and methodologies for cleaning a subterranean wellbore are provided.

More specifically, the present cleaning assembly may be used to remove debris from a wellbore, the assembly comprising at least one seal for sealingly positioning the cleaning assembly in the annulus of the wellbore, at least one pump for pumping debris from the wellbore, and at least one fluid flow control port for directing fluid downhole of the assembly. The assembly may be operative to receive pressurized fluids from the surface, at least a first stream of the fluid becoming "power" fluid to operate the pump and at least a second stream of the fluid becoming "cleaning" fluid, directed downhole by the fluid control port, for cleaning the wellbore downhole of the assembly. In one embodiment, the entire assembly may be configured to be positioned at or near the heel of the wellbore, and preferably at or within the lateral portion of the wellbore.

In some embodiments, the present assembly may further comprise a downhole 'tailpipe' tubing string, in fluid communication with, and extending downhole from, the assembly, for receiving debris being pumped from the wellbore. The downhole tubing string may have an uphole end, connected to the assembly, and a downhole end extending into the horizontal section of the wellbore. In some embodiments, the downhole end of the downhole tubing string lands at or near the toe of the horizontal section of the wellbore.

In some embodiments, the present assembly may further comprise an uphole 'return' tubing string, in fluid communication with, and extending uphole from, the assembly, for returning pumped fluids and debris from the assembly to the surface. The return tubing string may have a downhole end, connected to the assembly, for receiving pumped fluids (e.g. first and second fluid streams and debris from the wellbore) from the pump and for returning same to the surface. The uphole end of the return tubing string may be in fluid communication with fluid return systems at the surface.

More specifically, methods of cleaning a wellbore are provided, the methods comprising: sealingly positioning a cleaning assembly within the annulus of the wellbore, the assembly comprising at least one pump, for drawing debris from the wellbore, at least one fluid flow control port, for directing fluid downhole of the assembly; injecting a fluid stream into the annulus of the wellbore, a first portion of the stream serving to operate the pump, and a second portion of the stream passing through the fluid port to target debris in the annulus of the wellbore below the assembly; pumping the second fluid stream and the debris from downhole of the assembly through the downhole tubing string to the pump; and recovering the first and second fluid streams and the debris from the pump through the uphole tubing string.

BRIEF DESCRIPTION OF THE DRAWINGS

The present system will now be described by way of an example embodiment with reference to the accompanying simplified, diagrammatic, scale drawings. In the drawings.

DETAILED DESCRIPTION OF THE INVENTION

According to embodiments herein, apparatus and methodologies for cleaning a subterranean wellbore are provided. The present cleaning assembly is operative to evacuate debris from a wellbore, and particularly from the lateral section of a horizontal wellbore. The present cleaning assembly may be positioned at or near the lateral section of the wellbore, to ensure far-reaching and exhaustive cleaning in horizontal or deviated sections of the bore. The present cleaning assembly may be sealingly positioned within the wellbore, effectively isolating the entire annular space downhole of the assembly. The assembly may comprise, in combination, at least one fluid flow control port for controllably injecting fluid into the wellbore at a sufficient velocity to lift and carry debris towards the toe T of the wellbore, and at least one pump for withdrawing the debris from the wellbore and for returning the debris to the surface. A first elongate tubing string (i.e. a 'tailpipe'), in fluid communication with the downhole end of the pump, may be extended from the assembly into the horizontal section of the wellbore in order to reach debris from at or near the toe T of the wellbore. A second single tubing string (i.e. a 'return fluid string'), in fluid communication with the uphole end of the pump, may be used to return the fluids from the pump to the surface.

When describing the present systems, all terms not defined herein have their common art-recognized meanings. To the extent that the following description describes a specific embodiment or a particular use, it is intended to be illustrative only. The description is intended to cover all alternatives, modifications and equivalents. The scope of the claims should not be limited by the preferred embodiments set forth in the examples, but should be given the broadest interpretation consistent with the description as a whole.

Figure 1:
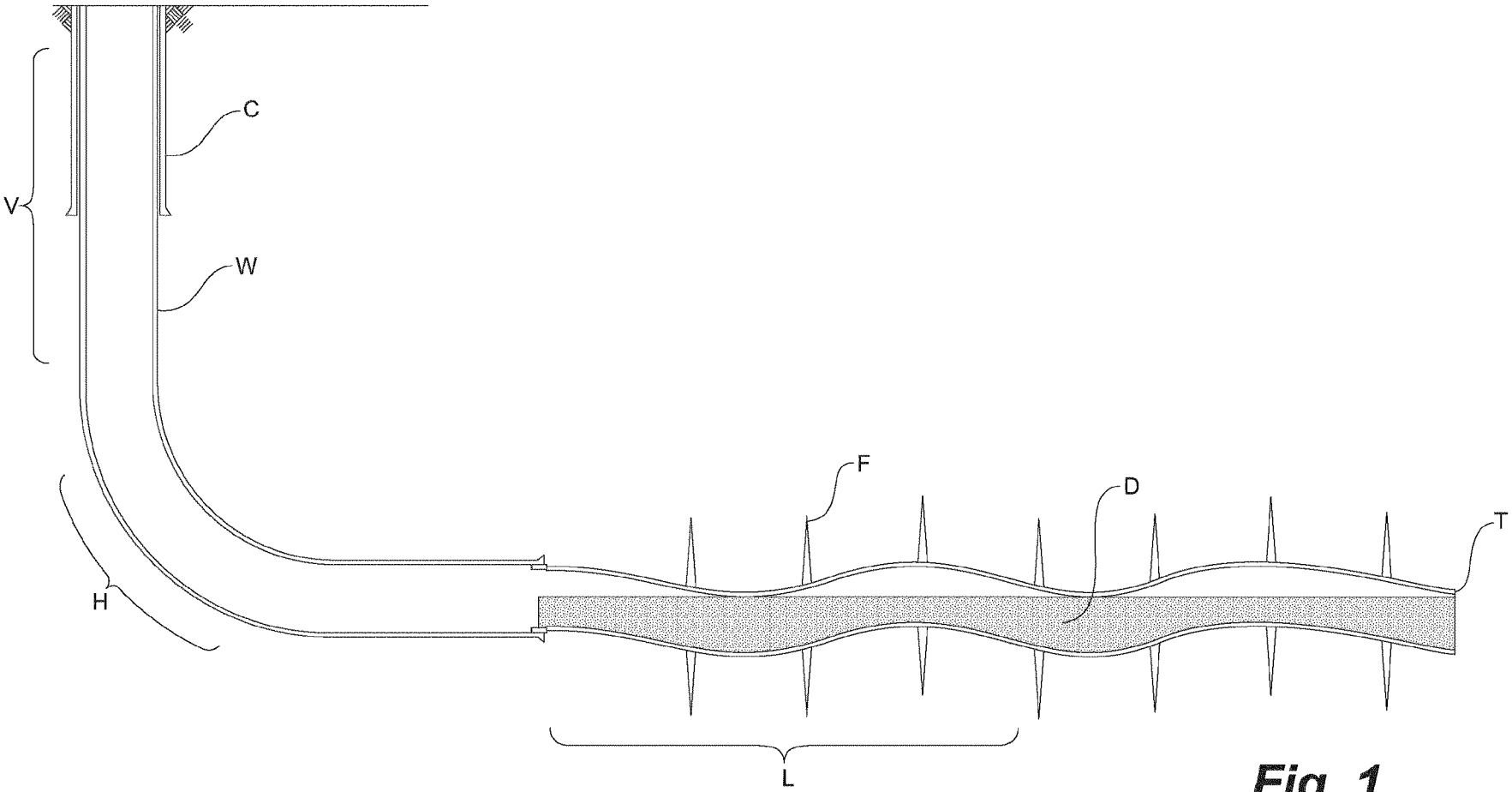
FIG. 1 is a schematic drawing of a subterranean wellbore having a typical horizontal configuration.

Having regard to FIG. 1, the present well cleanout system is described for use in a wellbore W formed in a hydrocarbon containing subterranean formation, the wellbore W having a relatively horizontal configuration consisting of a substantially vertical section V and a substantially lateral section L, connected by a 'curved' and 'angled' heel section H. The wellbore W has a proximal end at or near the surface, and a toe T at a distal end away from and opposite the proximal end. The wellbore W may have a casing with or without a well liner. The diameter of the wellbore may be consistent along its entire length, or may vary (e.g. at the casing-liner overlap zone). As would be known in the art, the wellbore W may comprise a plurality of perforations or frac ports F intermittently spaced along the lateral section L to provide fluid communication with the reservoir. It would be understood that embodiments of the present cleaning assembly may be in fluid communication with a fluid pumping unit, and a corresponding fluid return system at the surface. As would be understood, the present system may be deployed by an oilfield service rig S which may encompass, amongst other components, a tubing conveyance assembly (mast or other), one or more fluid pumps and surface tanks and fluids.

According to embodiments herein, the at least one cleaning assembly 10 may be positioned within the annulus A of the wellbore W. In some embodiments, the assembly 10 may be positioned distal to the heel section H of the wellbore, and preferably within the lateral section L of the wellbore. As would be understood by one skilled in the art of wellbore cleanout operations, the accumulation of debris may initially prevent the present cleaning assembly 10 from being positioned deep within the wellbore W and that, during operation, the present cleaning assembly 10 may be descended further downhole as sand and debris are removed and the wellbore becomes unplugged. In some embodiments, the present cleaning assembly 10 may be reconfigured (e.g. incorporating a shorter or longer tailpipe and/or return string) to optimize positioning of the assembly 10 and to extend cleanout operations as close as possible to the toe T of the wellbore. In other embodiments, the present cleaning assembly 10 may be positioned at a sufficient depth to achieve optimal fluid differentials above and below the assembly 10 (e.g. depending upon changes in bottom hole pressure and/or pump capacity, etc), minimizing fluids losses and impact upon the reservoir.

In operation, and once the cleaning assembly 10 is positioned in the wellbore W, a fluid from the fluid pumping unit at the surface may be injected into the annulus A of the wellbore W. The fluid may comprise a pressurized fluid, and may be any acceptable fluid used to both operate a pump and serve as a cleanout fluid. Conceptually, the fluid is injected into the annulus of the wellbore W where it reaches the assembly 10 sealed therewithin. Upon reaching the assembly 10, at least a first portion of the fluid serves to operate the cleaning assembly 10, and at least a second portion of the fluid is controllably diverted (e.g. jetted) downhole to clean the entire annulus of wellbore below the assembly 10. More specifically, a first portion of the injection fluid forms a 'power fluid stream' that enters the assembly 10 from the annulus to operate the assembly (e.g. the pump), while at least a second portion of the injection fluid forms a 'cleaning fluid stream' that is directed downhole from the assembly to clean the sealed wellbore therebelow. The cleaning fluid stream and entrained debris forms a 'return fluid stream' that is drawn/sucked from the wellbore back to the assembly 10 where it mixes with the power fluid stream operating the assembly and is returned to the surface.

Figure 2:
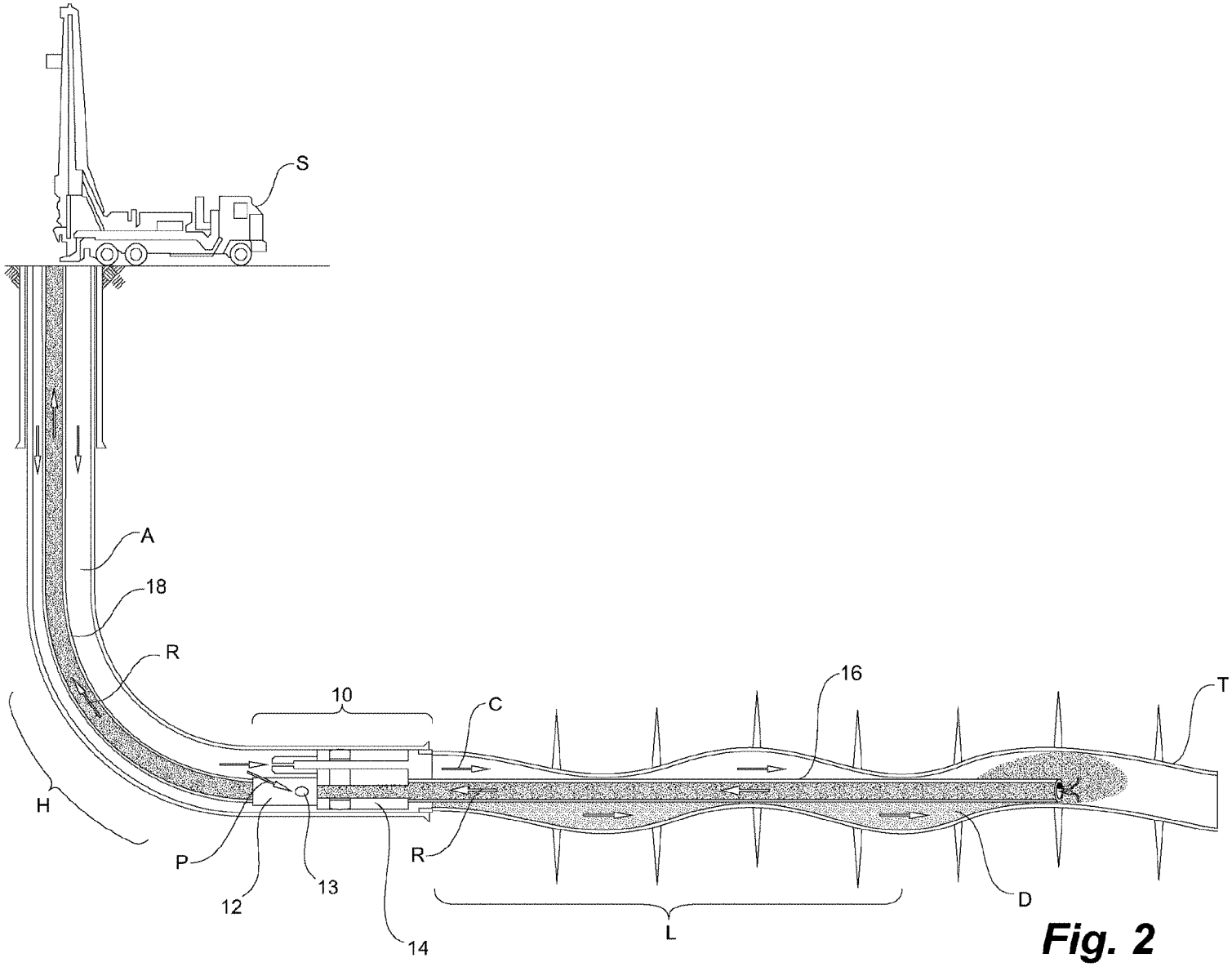
FIG. 2 is a schematic of the wellbore in FIG. 1 showing the present wellbore cleaning assembly according to embodiments herein.

More specifically, having regard to FIG. 2, the present cleaning assembly 10 may comprise at least one pump 12 and a fluid flow control port 14, each configured to receive pressurized fluid from the annulus A. As above, at least a first portion of the fluid injected into the annulus A may become a "power" fluid stream (arrows P) for operating the pump 12, while another portion of the injected fluid may become a "cleaning" fluid stream (arrows C) jetted downhole for lifting sand and debris from the isolated portion of the wellbore being cleaned below the assembly 10.

In one embodiment, the present cleaning assembly 10 may include an elongate 'tailpipe' tubing string 16. Tubing string 16, at its uphole end, may be in fluid communication with the downhole end of the pump 12 (via any appropriate connections, e.g. threaded connections). At its downhole (open) end, downhole tubing string 16 may extend into the sealed annulus of the wellbore being cleaned. In some embodiments, the tailpipe string 16 may extend from the assembly 10 to extend into the lateral section L of the wellbore. In some embodiments, the tailpipe tubing string 16 may extend from the assembly 10 until its downhole end lands at or near the toe T section of the wellbore. It would be understood that the length of the tailpipe string 16 may be increased or decreased in order to optimize cleaning of the wellbore.

In one embodiment, the present cleaning assembly 10 may also comprise a return tubing string 18. At its downhole end, return tubing string 18 may be in fluid communication with the uphole end of the pump 12, while its uphole end may be in fluid communication with the return fluid system at the surface. Each uphole and downhole end of the return tubing string 18 may comprise any appropriate attachment means, e.g. threaded connections.

As shown in FIG. 2, tailpipe string 16 forms a fluid pathway for receiving a return fluid stream R comprising at least the injected cleaning fluid C and any debris D from the wellbore entrained therein, and for transporting same to the assembly 10. One advantage of the single tubing string 16 used in the present assembly 10, along with injecting cleaning fluids directly into the annulus of the wellbore being cleaned, is that the present assembly 10 enables a relatively unrestricted flow path for the debris D being removed from the wellbore, while overcoming any potentially negative impact of the relatively large flow area upon downhole fluid velocities and bottomhole pressures.

Return tubing string 18 provides a fluid pathway for receiving the return fluid stream, mixed at the assembly 10 with the power fluid stream, and for transporting same from the assembly 10 to the surface. As such, fluids and debris returning from the cleaned wellbore combines with power fluid passing through the pump 12 and returns to the surface via tubing string 18. It would be appreciated that the size and length of tubing string 16,18 may be configured to optimize fluid velocities and cleaning of the wellbore, and in particular to optimize fluid flow from the wellbore below the assembly 10. It is an advantage of the present system is that any standard size tubing strings 16,18 may be used, further optimizing the present system and enabling easy insertion of the assembly 10 downhole.

Pump 12 may be any pump having an adjustable pump rate (e.g. bottom hole pressure and/or circulation rate may be controlled by the pump), such as a jet pump. Pump 12 may be configured to operate in reverse, receiving at least a portion of injected power fluid P from the annulus into the body of the pump and jetting the fluids received by the pump up the return string 18 to the surface. In one embodiment, pump 12 may comprise at least one intake port 13, extending through the pump housing, for admitting a portion of the power fluid P into the pump 12. It would be understood that flow of power fluid P through the pump 12 serves to create a lower pressure thereat, causing a suction effect within the tailpipe 16 and inducing wellbore debris D pushed downhole by cleaning fluid C to flow into the open downhole end of tailpipe 16. Fluid flow rates through the pump 12 may be controllably adjusted to optimize the production rate of the pump P, and the cleaning of the wellbore therebelow.

Figure 3:
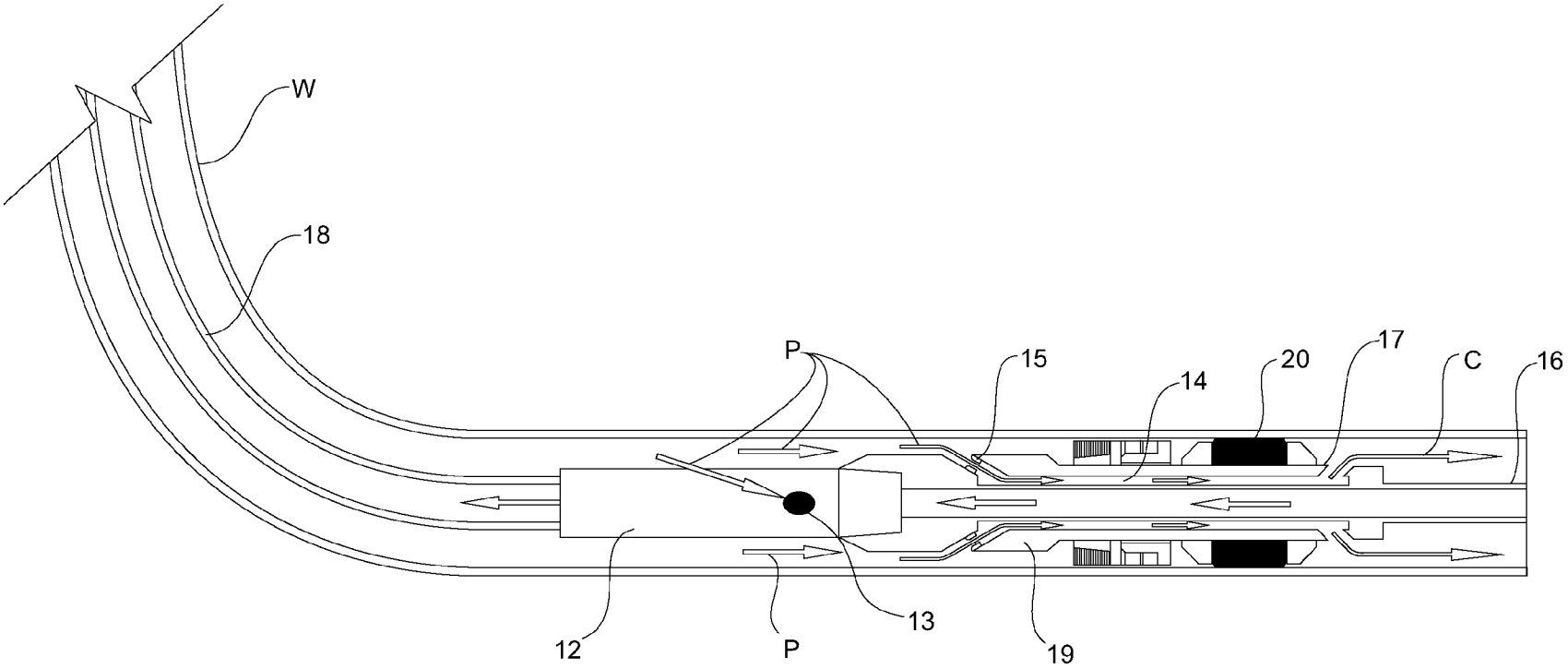
FIG. 3 is a schematic of the present wellbore cleaning assembly according to a first contemplated embodiment.
Figure 4:
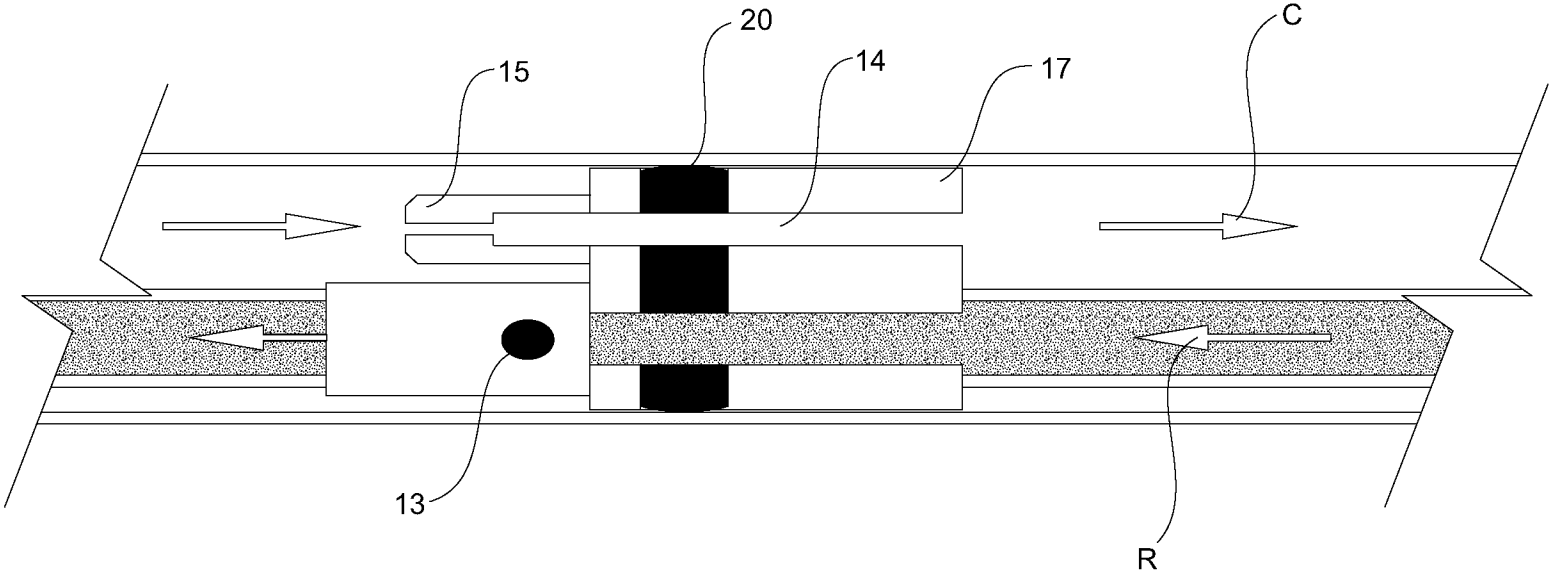
FIG. 4 is a schematic of the present wellbore cleaning assembly according to a second contemplated embodiment.
Figure 5:
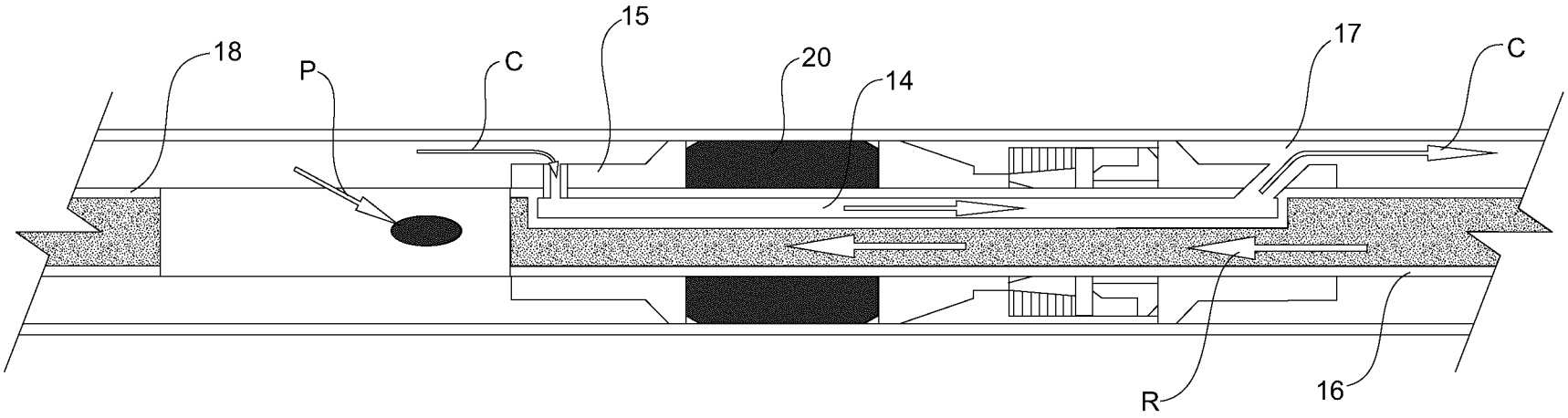
FIG. 5 is a schematic of the present wellbore cleaning assembly according to a third contemplated embodiment.

Having regard to FIGS. 3-5, fluid control port 14 may form a fluid pathway extending through the assembly 10 (e.g. for transporting fluids from the annulus uphole of the assembly through the assembly to the annulus therebelow). More specifically, fluid control port 14 may comprise an inlet end 15 and an outlet end 17. Fluid flowing under high pressure in the annular space uphole of the assembly 10 passes through inlet 15 (in the direction of arrows P) along port 15 and back into the annular space downhole of the assembly 10 through outlet 17. The cleaning fluid C exits the port 14 with sufficient velocity to stir up and entrain wellbore debris D, effectively becoming wellbore cleaning fluid. It would be understood that fluid control port 14 may be any size of configuration, and may be specifically designed for optimal cleaning of the wellbore W. For example, the size and/or shape of the port 14 may be determined based upon the balancing of various factors including, without limitation, the size of the reservoir, the size of the wellbore, the size of the tubulars and/or pump, bottom hole pressures and temperatures, the size of the debris and the transport velocity requirements, etc.

Having regard to FIG. 3, the at least one fluid port 14 may comprise an annular sleeve 19, received by (and encircling) the tailpipe tubing string 16, wherein port 14 is formed in the annular space between the outer wall of the tailpipe 16 and the inner wall of the sleeve 19. Contemplated embodiments of alternative configurations of the at least one fluid port 14 are depicted in FIGS. 4 and 5. It should be appreciated that any adaptation or modification of the present at least one fluid control port 14 may be used to achieve the present methodologies. Without limitation, it should be appreciated that the present at least one fluid control port 14 may enable the passage of fluid at a velocity that is sufficiently high to agitate and entrain all or most of the wellbore debris between the assembly 10 and the intake of the tailpipe 16, to carry the debris D to the downhole end of tailpipe string 16, and to remove it from the wellbore in the return fluid stream.

In some embodiments, the fluid control port 14 may be controllably opened and closed, such via a pressure-activated valve (not shown) actuated by a specific pressure threshold. When open, the at least one fluid control port 14 operates as above. When closed, all of the injected power fluid P will pass through the pump 12 and the pump 12 will only recover wellbore fluids from the wellbore.

Having further regard to FIGS. 3-5, cleaning assembly 10 may further comprise at least one seal component 20 for sealingly securing the cleaning assembly 10 to the wall of the wellbore W, thereby preventing the flow of fluid through the annulus and isolating the section of wellbore being cleaned below the assembly 10. The at least one seal 20 may be positioned within the assembly 10, and preferably at or near the pump 12 and fluid port 14. In some embodiments, the seal 20 may be positioned with the assembly 10 above or below the pump, and preferably at or below the pump 12. According to embodiments herein, the at least one seal 20 may comprise a dual-bore or dual-flow packing assembly, such as an inflatable packer. Seal 20 may be configured within the assembly 10 to form at least two distinct fluid pathways, such that at least cleaning fluid C may flow through port 14, and return fluids R and debris may be returned to the surface via return tubing string 18.

Broadly, having regard to FIGS. 1-5, a cleaning assembly 10 and methods of use for evacuating debris from a subterranean wellbore are provided. The present system benefits from the entire assembly 10 being positioned deep (or moveable) within the wellbore. Preferably, the entire assembly 10 may be positioned at or as close to the lateral section the wellbore as possible, enabling ideal positioning of the tailpipe tubing string 16 extending into the lateral section L. Positioning of the assembly 10 enables fluid velocities of the cleaning fluid C to be sufficient to lift and carry sand and debris D along the horizontal wellbore to the downhole end of the string 16.

As above, in operation, the present assembly 10 is operative to controllably route a single pressurized fluid into at least two fluid streams, a power fluid for operating the assembly and a cleaning fluid for generating turbulence along the length of the portion of wellbore being cleaned to effectively lift and transport sand and debris. The present system provides a simple cost-effective tool capable of efficiently cleaning deep wellbores, particularly horizontal or deviated wellbores.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. A cleaning assembly for removing debris from a wellbore, the assembly in fluid communication with fluid injection means for injecting fluid into the annulus of the wellbore, the assembly comprising:

at least one seal for sealingly positioning the cleaning assembly in the annulus of the wellbore, wherein the seal comprises a dual-bore packing seal;

at least one pump, having an uphole and a downhole end, for pumping debris from the wellbore, configured to receive at least one first stream of the injected fluid for operating the pump, an uphole tubing string in fluid communication with the uphole end of the pump and a downhole tubing string in fluid communication with the downhole end of the pump, the downhole tubing string the pump, and the uphole tubing string forming a continuous return fluid flow pathway, at least one fluid flow control port, configured to receive at least one second stream of the injected fluid, for directing the second stream of injected fluid into the wellbore annulus downhole of the assembly, wherein the first and second streams of the fluid and the debris is removed from the wellbore through the return fluid flow pathway.

2. The assembly of claim 1, wherein the pump comprises at least one pump intake port for receiving the first stream of injected fluid from the annulus of the wellbore.

3. The assembly of claim 1, wherein the fluid control port comprises at least one inlet for receiving the second stream of injected fluid from the annulus uphole of the assembly, and at least one outlet for expelling the second stream into the annulus downhole of the assembly.

4. The assembly of claim 1, wherein the seal is inflatable.

5. The assembly of claim 1, wherein the seal is positioned adjacent to or below the pump.

6. The assembly of claim 1, wherein the uphole and downhole tubing strings each comprise single tubing strings.

7. The assembly of claim 1, wherein the uphole end of the downhole tubing string is connected to the assembly, and the downhole end of the downhole tubing string extends into a horizontal section of the wellbore.

8. The assembly of claim 7, wherein the downhole tubing string extends into a toe section of the horizontal section of the wellbore.

9. A method of removing debris from an annulus of a wellbore, the method comprising:

providing a cleaning assembly, the cleaning assembly comprising a seal for sealingly positioning the cleaning assembly within the annulus of the wellbore, the seal comprising a dual-bore seal forming two distinct fluid flow pathways, the cleaning assembly having at least one pump, having an uphole and a downhole end, for pumping debris from the wellbore, an uphole tubing string in fluid communication with the uphole end of the pump and a downhole tubing string in fluid communication with the downhole end of the pump, the downhole tubing string having an inlet end and an outlet end, the inlet end being positioned within the wellbore downhole of the cleaning assembly for cleaning debris therefrom, the downhole tubing string the pump and the uphole tubing string forming a continuous return fluid flow pathway, and at least one fluid flow control port, for directing fluid from the annulus of the wellbore through the cleaning assembly to the wellbore downhole of the cleaning assembly, injecting a fluid stream into the annulus of the wellbore, at least a first portion of the fluid stream flowing to the pump for operation thereof, and at least a second portion of the fluid stream flowing through the at least one fluid port to clean debris from the wellbore downhole of the cleaning assembly, pumping the second fluid stream and the debris from the wellbore downhole of the cleaning assembly through the inlet end of the downhole tubing string to the pump, and removing the first and second fluid streams and the debris through the uphole tubing string.

10. The method of claim 9, wherein the wellbore is a horizontal or deviated wellbore and the cleaning assembly is positioned within a horizontal section of the wellbore.

11. The method of claim 9, further comprising increasing or decreasing the length of the downhole tubing string to reposition the inlet end of the downhole tubing string as debris from the wellbore downhole of the assembly is removed.

12. The method of claim 11, further comprising extending the length of the downhole tubing string deeper into the horizontal section of the wellbore.

13. The method of claim 12, wherein the method further comprises extending the inlet end of the downhole tubing string to the wellbore.

14. The assembly of claim 1, wherein the dual-bore seal forms two distinct fluid pathways.

15. The assembly of claim 14, wherein the second stream of the injected fluid directed into the wellbore annulus downhole of the assembly passes through a first seal pathway, and the first and second streams and the debris removed from the wellbore pass through a second seal pathway.

16. The assembly of claim 9, wherein the second stream of the injected fluid is transferred through a first seal pathway to the wellbore below the assembly, and the first and second fluid streams and the debris removed from the wellbore is transferred through a second seal pathway.

* * * * *